United States Patent [19]

Horst, Jr. et al.

[11] Patent Number: 4,581,998

[45] Date of Patent: Apr. 15, 1986

[54] PROGRAMMED-SPLITTING SOLID PROPELLANT GRAIN FOR IMPROVED BALLISTIC PERFORMANCE OF GUNS

[75] Inventors: Albert W. Horst, Jr.; Frederick W. Robbins, both of Aberdeen, Md.

[73] Assignee: The United States of America as represented by the Secretary of the Army, Washington, D.C.

[21] Appl. No.: 746,427

[22] Filed: Jun. 19, 1985

[51] Int. Cl.[4] ..... C06B 45/00

[52] U.S. Cl. ..... 102/289; 102/292; 60/253

[58] Field of Search ..... 102/286, 289, 292; 60/253

[56] References Cited

U.S. PATENT DOCUMENTS

| | | | |
|---|---|---|---|
| 838,748 | 12/1906 | Du Pont | 102/287 X |
| 3,048,076 | 8/1962 | Capener et al. | 102/290 X |
| 3,109,375 | 11/1963 | Rumbel et al. | 102/287 X |
| 3,157,025 | 11/1964 | Herring | 102/290 X |
| 3,166,896 | 1/1965 | Breitengross, Jr. | 102/291 X |
| 3,309,869 | 3/1967 | Terry | 60/253 X |
| 3,499,283 | 3/1970 | Simpkins | 60/253 X |
| 3,529,550 | 9/1970 | Snowden | 102/291 |
| 3,691,955 | 9/1972 | Jordan et al. | 102/291 |
| 4,013,743 | 3/1977 | Blasche, Jr. et al. | 102/289 X |
| 4,474,715 | 10/1984 | Weber et al. | 102/288 X |

*Primary Examiner*—Peter A. Nelson

*Attorney, Agent, or Firm*—Anthony T. Lane; Robert P. Gibson; Michael C. Sachs

[57] ABSTRACT

The invention is an improved solid propellant grain, wherein the solid propellant grain is structured to provide a programmed method and system for splitting the solid propellant grain at a programmed moment to provide an increase in the burning surface. The programmed-splitting of the solid propellant grain provides improved ballistic performance of guns, which yields a higher muzzle velocity for a given projectile without increasing the maximum pressure exerted on the gun chamber. The improvement consists of embodiments that are a plurality of slits of various configurations through the longitudinal length of each grain of solid propellant. The improvement includes a structure to delay end burning of the grains until the longitudinal exterior surface burns sufficiently to split the grain into a plurality of sections at a programmed moment when the increased burning surface is desired to occur. The improvement also consists of another embodiment wherein the grain is structured in a spiral configuration to provide a similar increased burning surface for a programmed moment when the increased burning surface is desired to occur.

3 Claims, 18 Drawing Figures

PROGRAMMED-SPLITTING SOLID PROPELLANT GRAIN FOR IMPROVED BALLISTIC PERFORMANCE OF GUNS

BACKGROUND AND SUMMARY OF THE INVENTION

The invention described herein may be manufactured, used, and licensed by or for the government for governmental purposes without the payment to us of any royalties thereon.

The invention relates to propellants for missiles being fired or launched from guns and in particular to solid propellant grain. Specifically, the invention relates to a programmed-splitting of a solid propellant grain for improved ballistic performance of guns.

The purpose of this invention is to provide improved ballistic performance of guns. The invention itself is a new concept for a solid propellant grain, application of which will yield a higher muzzle velocity for a given projectile without increasing the maximum pressure exerted on the gun chamber. The technique is based on increasing the burning surface by splitting of the propellant grain after maximum pressure in the gun has been achieved, allowing for the more efficient use of available propellant energy, as well as for the possible use of increased propellant charge weights, in order to impart a higher velocity to the projectile without increasing maximum breech pressure.

The invention is an improved solid propellant grain, wherein the solid propellant grain is structured to provide a programmed method and system for splitting the solid propellant at a programmed moment to provide the aforementioned increase in the burning surface.

The improvement consists of a first embodiment that is a plurality of slits of various configurations through the longitudinal length of each grain of solid propellant. The improvement includes a structure to delay end burning of the grains until the longitudinal exterior surface burns sufficiently to split the grain into a plurality of sections at a programmed moment when the increased burning surface is desired to occur.

The improvement also consists of a second embodiment wherein the grain is structured in a spiral configuration to provide a similar increased burning surface for a programmed moment when the increased burning surface is desired to occur.

Regarding the prior art of solid propellants, the velocity achieved by a projectile as it exits the muzzle of a gun is principally the result of the pressure history acting on its base while it travels down the bore of the tube. The maximum pressure value allowable is usually dictated by gun tube design, but the actual pressure profile, apart from this maximum value, exerted on the projectile base is a result of the competition between the quantity of gas produced by the burning propellant and the amount of free volume available. At the beginning of the event, the projectile is not moving or is moving only very slowly, so the pressure rises as the propellant burns. However, as the projectile speeds up, it eventually creates additional volume much faster than gases are created to fill it. As a result, in virtually all cases, the pressure falls off much more rapidly than desired.

Past attempts to counter this problem have involved the use of propellant charges consisting of an aggregate of grains which are right circular or hexagonally-shaped cylinders with single or multiple perforations (typically one, seven, nineteen, or thirty-seven) passing through the cylinder parallel to the axis of symmetry. As the propellant burns on all surfaces, the area associated with the perforation walls increases while the external area decreases. The net effect is a neutral or even progressive evolution of surface as the grain burns. Increases in surface area, however, commence with the start of burning rather than after peak pressure is achieved and are limited by practical considerations to a value which is about twice the initial surface area. Muzzle velocity increases associated with the use of even the 37-perforation grain are limited to only about 2–3% when compared to charges composed of more conventional grain configurations. Greater progressivity is theoretically achievable with a single, large, many-perforated monolithic propellant grain, a concept that has never been reduced to practice because of both difficulties in manufacturing and more fundamental problems associated with combustion in very long perforations.

A second technique involves the use of deterrents or inhibitors on the outer regressive surfaces to reduce or even eliminate burning in these regions, thereby increasing the net effect of burning in these regions, thereby increasing the net effect of burning on the progressive perforation surfaces. Unfortunately, deterrent technology is more of an art than a science and requires an iterative approach to successful charge design, usually not economically feasible for medium- and large-caliber guns. Inhibitor coatings, simpler in concept, have not yet been developed which survive the gun interior ballistic environment. A related (but more successful to date) variation of this technique is deterred ball propellant, often used to allow the use of greater charge weights (and hence more total propellant energy) in small arms. The individual propellant grains are oblate spheres, the outside layers of which have been chemically deterred to slow the burning rate until the projectile has moved out far enough to create the volume required for burning such a quantity of propellant without overpressurizing the gun.

One additional technique which has received much attention is known as the consolidated charge. Conceptually, grains of any of the above types (except monolithic) can be softened by solvation or heat and compacted to higher than usual loading densities, increasing the maximum loadable charge weight for a given system. The initial reduction in surface area resulting from the intimate contact between and bonding to adjacent grains followed by a subsequent increase in surface area as the compacted charge deconsolidates during burning may also be a means of increasing the progressivity of the evolution of available burning surface. This concept is hampered, however, by an incomplete understanding of the deconsolidation and flamespreading events and by manufacturing and reproducibility problems.

Considering the present invention in comparison to the prior art, this invention possesses a number of significant advantages over prior art described hereinbefore. First, the increase in surface area can be programmed to commence at the most efficient time in the burning process, rather than being operational as soon as the propellant is ignited. Thus, a very-high loading density charge can be employed without excessive burning surface and overpressurization of the gun early in the ballistic cycle. Second, the increase in surface area at the prescribed burn distance is theoretically unlimited. Thus, despite a desirably low initial burning surface, this programmed increase in burning surface after peak pressure assures total burning of the charge before the projectile exits the gun and again makes possible the use of very-high density charges for significant increases in ballistic performance. Third, the concept can be applied to conventional granular and stick propellants with both cylindrical and hexagonal outer surfaces, manufacturing technology for which is well in hand. The concept can also be applied to multi-layered scroll propellants, perhaps easily manufactured from propellant sheet stock. Finally, loading densities as high as those possible with most consolidated charges are possible without compromising the complete programmability of the burning surface profile or experiencing reproducibility problems such as those apparently associated with the deconsolidation process.

It is, therefore, an object of this invention to provide a solid propellant grain for improved ballistic performance of guns which permits an increase in projectile muzzle velocity (up to 5%) at the same maximum chamber pressures using existing propellant formulations and charge weights.

It is another object of this invention to provide a solid propellant grain for significantly improved ballistic performance of guns which permits large increases in projectile muzzle velocity (more than 10%) at the same chamber pressure with what would be otherwise ballistically unacceptable increases in charge weight of conventional propellant formulations.

It is also an object of this invention to provide a solid propellant grain for improved ballistic performance of guns wherein increased projectile muzzle velocities can be achieved without the necessity for increasing the structural capability of the weapon.

It is a further object of this invention to provide a solid propellant grain wherein current projectile muzzle velocities can be achieved at lower maximum chamber pressures.

Still another object of this invention is to provide a solid propellant grain wherein current projectile muzzle velocities can be achieved with lower peak projectile acceleration forces to increase launch survivability of existing and developmental projectiles.

Yet another object of this invention is to provide a solid propellant grain for improved ballistic performance of guns without the need for great capital investment in terms of manufacturing facilities or technology.

It is yet still another object of this invention to provide a solid propellant grain for improved ballistic performance of guns wherein the grain achieves a large, programmable increase in burning surface, and hence gas generation rates, after the achievement of peak chamber pressure in the gun.

Further objects and advantages of the invention will become apparent in light of the following description of the preferred embodiments.

DESCRIPTION OF THE PREFERRED EMBODIMENTS

Figure 1:
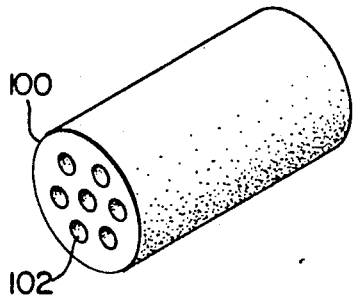
FIG. 1. (PRIOR ART)
FIG. 1 is a perspective view of a prior art solid propellant grain, sharing a plurality of longitudinal perforations therethrough.

Referring now to the drawings, and particularly to FIGS. 3, 4, 10, 11, 12, 13 and 14 a programmed-splitting solid propellant grain is shown at 20, 30, 40, 50, 60, 70, and 80 for improved ballistic performance of guns.

Figure 3:
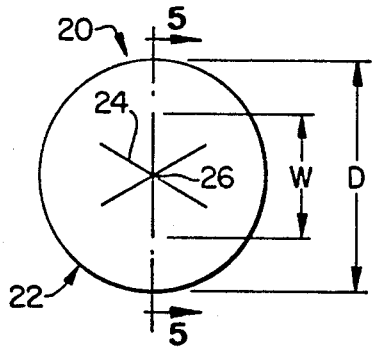
FIG. 3 is a cross-sectional view of a first embodiment of an improved grain of solid propellant of right circular-shaped cylinder configuration.

A first embodiment of a programmed-splitting solid propellant grain 20 is shown in FIG. 3. In this first embodiment the programmed-splitting solid propellant grain 20 the configuration is a right circular-shaped cylinder with a plurality of straight slits longitudinally therethrough, the solid propellant grains each have a smooth exterior surface. A detailed description is provided hereinafter.

Figure 4:
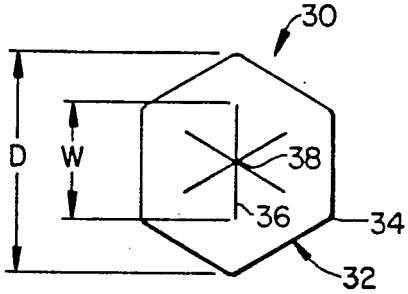
FIG. 4 is a cross-sectional view of a second embodiment of an improved grain of solid propellant of right hexagonally-shaped cylinder configuration.

A second embodiment of a programmed-splitting solid propellant grain 30 is shown in FIG. 4. In this second embodiment the programmed-splitting solid propellant grain 30 the configuration is a right hexagonally-shaped cylinder or prism with a plurality of straight slits longitudinally therethrough, the solid propellant grains each have a smooth exterior surface. A detailed description is provided hereinafter.

Figure 10:
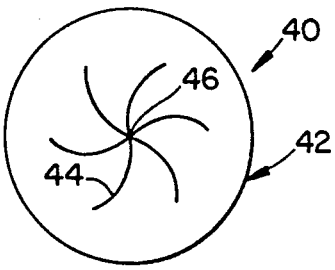
FIG. 10 is a cross-sectional view of a third embodiment of an improved grain of solid propellant.

A third embodiment of a programmed-splitting solid propellant grain 40 is shown in FIG. 10. In this third embodiment the programmed-splitting solid propellant grain 40 the configuration is a right circular-shaped cylinder with a plurality of curved or arc-like slits longitudinally therethrough. A detailed description is provided hereinafter.

Figure 11:
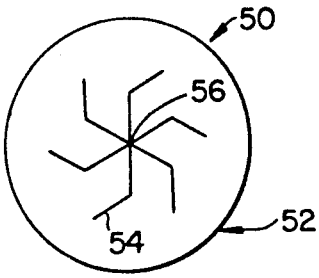
FIG. 11 is a cross-sectional view of a fourth embodiment of an improved grain of solid propellant.

A fourth embodiment of a programmed-splitting solid propellant grain 50 is shown in FIG. 11. In this fourth embodiment the programmed-splitting solid propellant grain 50 the configuration is a right circular-shaped cylinder with a plurality of angled slits longitudinally therethrough. A detailed description is provided hereinafter.

Figure 12:
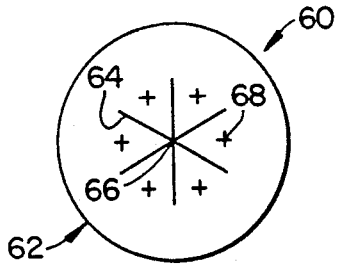
FIG. 12 is a cross-sectional view of a fifth embodiment of an improved grain of solid propellant.

A fifth embodiment of a programmed-splitting solid propellant grain 60 is shown in FIG. 12. This fifth embodiment is similar to the first embodiment except that a plurality of slit-like perforations are spaced around and among the main slits through the grain. A detailed description is provided hereinafter.

It is to be understood that it is within the scope and intent of this invention to create other embodiments of a programmed-splitting solid propellant grain by combining various characteristics of the invented structures shown in the first, second, third, and fourth embodiments 20, 30, 40, and 50, respectively, for a programmed-splitting solid propellant grain.

For example: the plurality of curved or arc-like slits of the third embodiment can be used in a grain that is a right hexagonally-shaped cylinder or prism; the plurality of angled slits of the fourth embodiment can be used in a grain that is a right hexagonally-shaped cylinder or prism; a plurality of various combinations of straight, curved or arc-like, and angled slits can be used in a grain that is either a right circular-shaped cylinder or in a grain that is a right hexagonally-shaped cylinder or prism; and the straight, curved or arc-like, and angled slits can be used separately or various combinations thereof in other geometrically shaped grains of solid propellants. All such combinations as other embodiments being within the scope and intent of this invention.

It is important to note at this point that in programming the grain of solid propellant to achieve the exact burning time desired and to achieve that burning time in the plurality of rates of burning-time that are all included in the overall program; such as the initial burning time, and the burning time after the grain of solid propellant splits due to the initial burning which, in total burning time, is that which has been programmed. It is this programmed-splitting of the solid propellant grain from a time standpoint that provides the improved ballistic performance of the guns, and from which it yields a higher muzzle velocity for a given projectile, without increasing the maximum pressure exerted on the gun chamber.

Thus, with the combination of the various solid propellant grain configurations and the various combinations of longitudinal slits through the grains, the programming of the burning time can be determined to meet the needs for various given projectiles in various given gun designs.

Figure 13:
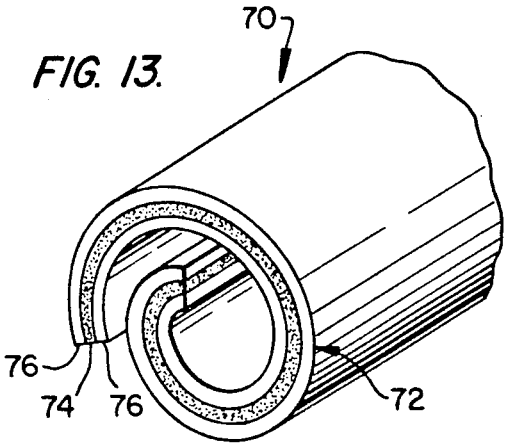
FIG. 13 is a partial pictorial cross-sectional view of a sixth embodiment of an improved grain of solid propellant in scroll form.
Figure 14:
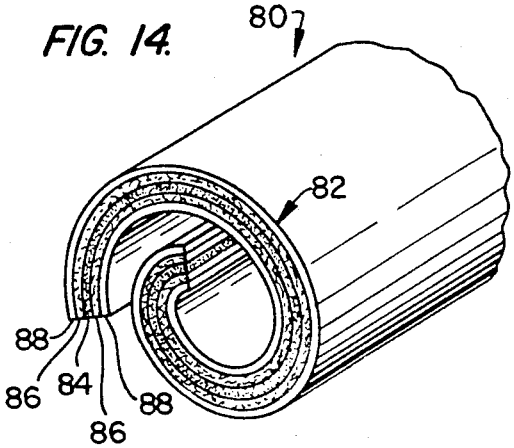
FIG. 14 is a partial pictorial cross-sectional view of a seventh embodiment of an improved grain of solid propellant in scroll form.

In addition, specific sixth and seventh embodiments are within the scope and intent of this invention for programmed-splitting solid propellant grains 70 and 80 that are structured in a spiral configuration as shown in FIGS. 13 and 14. A detailed description of each is provided hereinafter.

Turning now to a detailed description of the various embodiments mentioned hereinbefore and to other details of the invention, FIG. 1 is a perspective view of a prior art, circular-shaped cylinder of solid propellant grain 100. In this prior art grain 100 a plurality of perforations 102 are shown longitudinally therethrough.

As noted hereinbefore, the velocity achieved by a projectile as it exits the muzzle of a gun is principally the result of the pressure history acting on its base while it travels down the bore of the tube. As also noted, various problems developed in the initial gun designs using a solid propellant grain. Also as noted, in the prior art past attempts to counter these problems consisted primarily of single or multiple perforations longitudinally through each of the grains of solid propellant, such as the prior art as shown in FIG. 1.

These prior art perforations through the grain increased the burning surface, but did not provide for programming a variation in the burning surface or surfaces of the grain during the total burning cycle. The present invention overcomes this problem by providing a grain that is programmed to split into a plurality of sections or segments at a precise moment during the burning cycle and, at that moment further increase the total burning surface. The details are described hereinafter.

FIGS. 3, 4, 10, 11, 12, 13 and 14 show the primary embodiments of the present invention as initially described hereinbefore, detailed descriptions follow. However, it is to be noted that other embodiments of the invention are possible within the scope and intent of this invention, as described hereinbefore, by combining certain characteristics of the primary embodiments to achieve variations in the programmed-splitting of the solid propellant grain to obtain the improved ballistic performance of guns.

The primary embodiments of a solid propellant grain structured in accordance with the present invention are shown in cross-sectional view as follows: first embodiment 20 in FIG. 3; second embodiment 30 in FIG. 4; third embodiment 40, in FIG. 10; fourth embodiment 50 in FIG. 11; and fifth embodiment 60 in FIG. 12. Sixth and seventh embodiments 70 and 80, respectively, in FIGS. 13 and 14, respectively are covered later hereinafter as a scroll configuration grain. Note in the drawings, and as other described hereinbefore, that the general configuration of these solid propellant grains may be either circular, hexagonal, or other geometrical-forms, in cross-sectional views. The first, primary embodiment 20 is shown as a circular configuration 22; the second primary embodiment 30 is shown as a hexagonal configuration 32 with the flat outer surfaces joined, preferably, by rounded longitudinal edges 34; the third primary embodiment 40 is shown as a circular configuration 42; the fourth primary embodiment 50 is shown as a circular configuration 52; and the fifth primary embodiment 60 is shown as a circular configuration 62.

Extending longitudinally through the solid propellant grains are a plurality of slits, the longitudinal axes of which are all coincidental with the axis of the grains. In the first primary embodiment 20, the slits 24 are straight or flat slits and are coincidental with the grain axis 26. In the second primary embodiment 30, the slits 36 are also straight or flat and are coincidental with the grain axis 38. In the third primary embodiment 40, the slits 44 are curved or arc-like and are coincidental with the grain axis 46. In the fourth primary embodiment 50, the slits 54 are angular and are coincidental with the grain axis 56. The fifth primary embodiment 60 being of a circular configuration 62 is a combination of main slits 64 and are coincidental with the grain axis 66 and spaced slit perforation 68.

It is to be noted that the plurality of slits 24, 36, 44, 54, and 64, respectively, are illustrated in the drawing of six single slits each having one end or side at the common grain axis 26, 38, 46, 56 and 66, respectively, for purposes of clarity. However, it is to be understood that the plurality of such slits may be any number as determined by the program for programmed-splitting of the solid propellant grains.

The width W, or diametrical extent, and number of slits for each embodiment are critical and are unique to the specific ballistic application of interest: the width being determined relative to the overall grain diameter D such that exposure of the slits due to surface regression of the exterior surface from burning does not occur until after peak pressure in the gun has been achieved; the number of slits being determined so as to provide the appropriate increase in burning surface to increase subsequent pressure levels without exceeding the maximum allowable value.

The overall configuration of the grain leads to a large increase in burning surface after peak pressure, thus maintaining higher subsequent pressure levels and decreasing projected muzzle velocity without increasing the maximum pressure.

Figure 2:
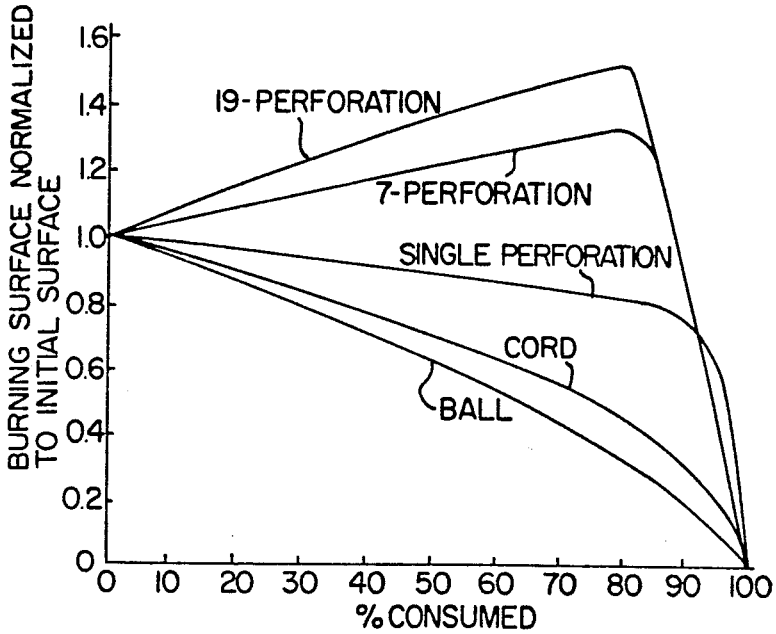
FIG. 2 is a graph showing the evolution of the surface of a grain of solid propellant as the grain burns.

Referring now to FIG. 2, the graph shows the evolution of the surface of a grain of solid propellant of the prior art as the grain burns. The net effect is a neutral or even progressive evolution of the surface as the grain burns, as described hereinbefore.

Figure 5:
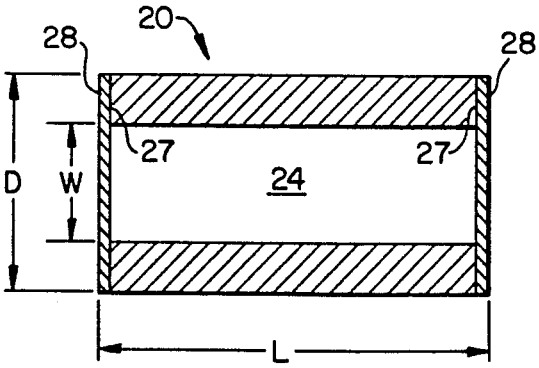
FIG. 5 is a longitudinal cross-sectional view of FIG. 3 on line 5—5, showing a coating on the ends of said improved grain of solid propellant.
Figure 6:
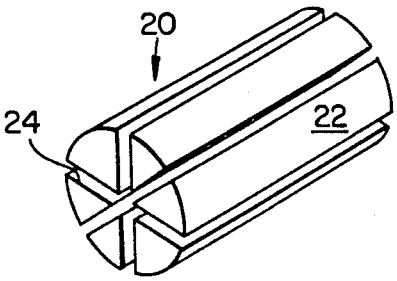
FIG. 6 is a perspective view of an improved grain of solid propellant which as separated into predetermined sections at a programmed moment of the burning phase.

To further control and program the grains of the present invention for splitting at a precise moment, to increase the burning surface, an additional characteristic component is introduced into the overall structure of the first, second, third, fourth, and fifth embodiments, 20, 30, 40, 50, and 60, respectively, as described hereinafter. The ends of a typical grain may be coated to prevent flame from reaching the surfaces of the slits until the grain separates into pie-shaped wedges, as shown in FIG. 6, when the outer sidewall regresses through burning to the point of exposing the slits. FIG. 5 shows the ends 27 of the first embodiment 20 coated or chemically deterred 28 in a longitudinal cross-sectional view along the lines 5—5 of FIG. 3. It is to be noted that for clarity and simplification, FIG. 5 is a longitudinal cross-sectional view through the first embodiment 20.

However, it is to be understood that this FIG. 5 also represents a typical longitudinal cross-sectional view through the second, third, fourth and fifth embodiments, 30, 40, 50 and 60 respectively, wherein the ends of the grain can also be coated or chemically altered 28 in a similar manner. The coating or chemical alteration 28 may be a physical coating or it may be a chemical alteration 28 to prevent penetration of the flame into the slits until they have been exposed by regression of the outer sidewall surface from burning of the propellant.

Figure 7:
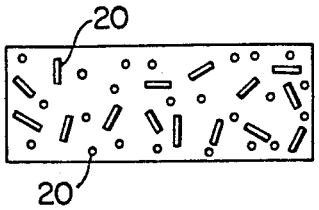
FIG. 7 is a schematic view of random loaded grains of solid propellant in a charge suited to specific grain length-to-diameter ratios.
Figure 8:
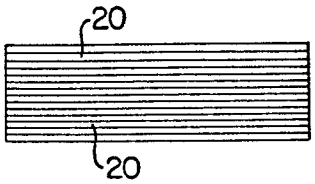
FIG. 8 is a schematic view of bundles of very high length-to-diameter ratios of solid propellant sticks.

The length L of the typical grain 20 may be varied to suit the particular application. Grain length-to-diameter ratios of less than 10 may be loaded randomly in a charge, as shown in FIG. 7. The bulk loading density of the random-loaded charge can be increased if this ratio is decreased to about two. Even greater bulk loading densities can be achieved if one takes advantage of the tight packing of cylindrical sticks or, in the limit, hexagonal or other geometrically configured sticks. Bundles of very high length-to-diameter ratio propellant, shown in FIG. 8, may thus be used to achieve the very high loading densities made ballistically feasible by this invention. The matter of length to diameter ratios applies also to the improved solid propellant grains 30, 40, 50 and 60, the typical grain 20, shown in FIG. 5 being representative of these other embodiments as well. The applications shown in FIGS. 7 and 8 are representative of the use of all embodiments.

Referring again to FIG. 6 it can be seen how the typical improved grain 20 (or improved grains 30, 40, 50, and 60) will split into a plurality of pie-shaped or wedge-shaped sections or segments when the outer wall of the grains 20, 30, 40, 50, or 60, as shown in FIGS. 3, 4, 10, 11, and 12, respectively, regresses through burning to the point where the outer-most edges of the slits are exposes. At this point an immediate increase in burning surface is generated, which is the result of the planned programmed-splitting of the solid propellant grain to gain the improved ballistic performance of the guns.

The chemical composition of the propellant utilized in the manufacture of the typical grain may be any of those currently known in the art. These include the generally accepted designations M1, M2, M5, M6, M8, M9, M15, M26, M30, and M31. Solventless-processed propellants, such as JA2 NOSOL 318 and NOSOL 363 may be particularly suited for this application. Further, developmental low-vulnerability propellants, designated LOVA, may also be appropriate, as are any other propellant formulations the combustion of which may be characterized by regression normal to the burning surfaces. Production of the grains may be realizable using normal propellant extrusion techniques.

In summary, the central element of this invention pertains to the embedded slits within the solid propellant grain providing the capability to program a splitting of the grain at a specific burn distance, the purpose being to provide large increases in burning surface after peak pressure in the gun has occurred so as to raise subsequent pressures and likewise provide significant increases in projectile muzzle velocity without increasing peak chamber pressure.

Figure 9:
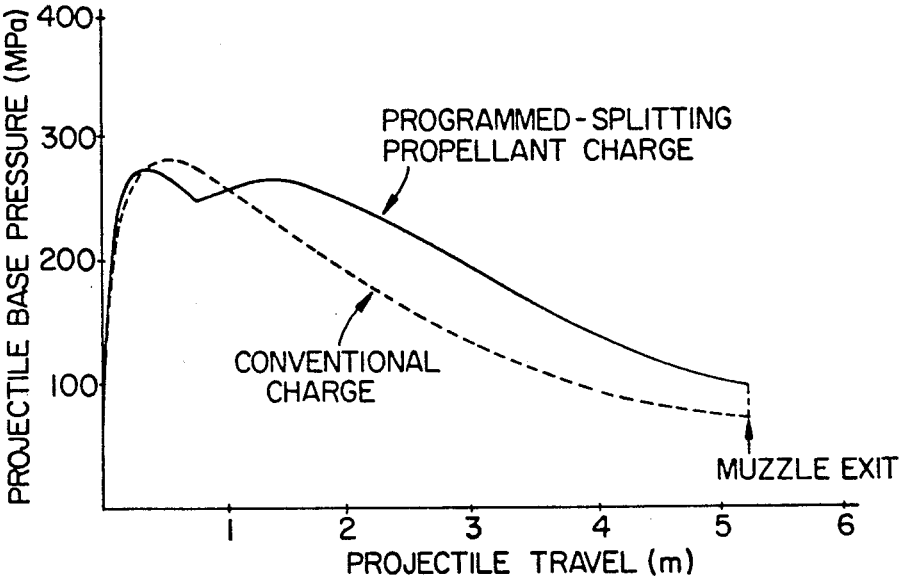
FIG. 9 is a graph showing a comparison of projectile travel versus projectile base pressure for a conventional propellant charge and for a programmed-splitting propellant charge.

As noted at the beginning of the description of the present invention, a propellant charge comprising solid propellant grains structured in accordance with the present invention provides improved ballistic performance in a number of alternative fashions. Referring, therefore, to FIG. 9, it provides a graphic comparison of the results from theoretical calculations for the projectile base pressure versus projectile travel for a conventional propellant charge and for a propelling charge employing propellant grains structured in accordance with the present invention. It is to be noted that, while the maximum chamber pressure may be made to be identical, a higher average pressure is experienced at the base of the projectile during most of its inbore trajectory, this pressure providing the propelling force responsible for the ballistic advantages offered by the present invention.

For a particular system, the 155 mm, M198 Howitzer, operating at a maximum chamber pressure of 327.5 MPa, a charge of increased weight (an increase which is still loadable but not usable with conventional grain configurations, because it would lead to either overpressurization or incomplete burning) using a propellant structured in accordance with this invention may be configured to achieve a 10 to 15% increase in projectile muzzle velocity at the current maximum pressure limit.

The advantages of higher projectile muzzle velocity include longer ranges, shorter times of flight, and greater penetration and lethality. The alternatively availalble advantages associated with a lower maximum chamber pressure include greater fatigue life for gun and breech mechanisms, increased reliability of existing projectiles, and launch survivability for new, sophisticated projectile systems. A compromise between the two alternative classes of benefit is, of course, also possible.

Turning now to the structure of the fifth embodiment 60 of a programmed-splitting solid propellant grain for improved ballistic performance of guns, note that in addition to the main slits 64 there are a plurality of spaced perforations 68 in a slit form of configuration. It is to be understood that it is within the scope and intent of this invention to combine such spaced perforations 68 in slit form, or in other geometrical forms, in the other embodiments described hereinbefore.

In regard to the combination of differently configured main slits, differently configured main grains, and differently configured perforations, it is to be understood that all such combinations are within the scope and intent of this invention. It must be kept in mind that this invention provides for controlling the subsequent ignition times after the programmed-splitting of the grain takes place and thereby also controls the burning time at its various intensities. This is the thrust of this invention, in that the splitting and burning history can be controlled to provide the improved ballistic results desired, as hereinbefore described. This programming and control also pertains to the scroll configured grains of propellant described hereinafter. The programmed design enhances the effect geometrically by providing a progressive increasing burning surface as a function of surface regression after the time of the theoretically discontinuous increase upon splitting.

Turning now to FIGS. 13 and 14, scrolled embodiments of the programmed-splitting solid propellant grains 70 and 80, respectively, are shown for improved ballistic performance of guns.

FIG. 13 shows simple three layer grain in scroll formation 72 and FIG. 14 shows a multi-layered grain in scroll formation 82 where there are a plurality of layers.

It is to be noted and understood that the plurality of layers in either the simple form shown in FIG. 13 or the multi-layered form shown in FIG. 14 may be such multiples as 3, 5, 7, and so on, all of which are within the scope and intent of the present invention.

In the sixth embodiment 70 in FIG. 13, the center layer 74 is a faster burning component and the outer layers 76 are composed of a slower burning or less energetic composition. Thus, the faster burning layer 74 is sandwiched in between the two slower burning outer layers 76. In this case there is a discontinuous increase in the gas generation rate which occurs when the regression reaches the central layer of propellant. Here, again, the composition is programmed for the same effect as the splitting in the aforementioned embodiments and for control purposes.

Figure 16:
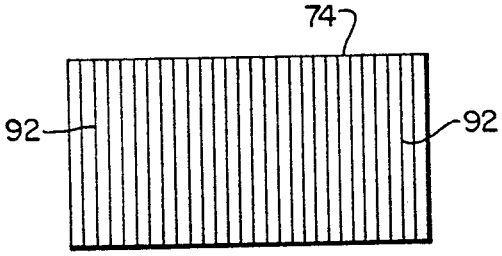
FIG. 16 if a plan view of a layer of scored solid propellant prior to being formed into a scroll.

To further enhance the programming for control of the burning, the central layer 74 may be perforated 90 as shown in FIG. 16 before the layer 74 is set between the outer layers 76 and formed into the scroll configuration. The plurality of perforation 90 is a function of the program set for the particular grain 70 regarding the control of its burning.

An alternative to the plurality of perforation 90 is a plurality of scoring lines or cuts 92 in the surface of the central layer 74 before the layer 74 is set between the outer layers 76, as shown in FIG. 16.

Once the layers 74 and 76, respectively, are assembled, the combination is then rolled into the scroll configuration 72 to provide rigidity and promote uniform ignition and burning.

As a seventh embodiment 80, a plurality of layers of propellant, in other words multi-layered, are formed into a scroll 82 configuration as shown in FIG. 14. In this embodiment the fastest burning layer 84 is at the center of the formation, then moderate burning layers 86 are on each side of the fastest burning layer 84, and the slowest burning layers 88 are the outermost layers. Once so assembled, the combination is then rolled into the scroll configuration 82 to provide rigidity and provide uniform ignition and burning. The burning effect and history follows the same path as described hereinbefore for the sixth embodiment, except that the programming of the recession of the various layers in as according to the combination of layers in the configuration.

It is to be noted and understood that it is within the scope and intent of this invention that the plurality of layers in the seventh embodiment 80 is not limited to that described, this limitation to five layers and to the particular combination of a fast burning layer 84, moderate burning layers 86, and slow burning outermost layers 88 is for illustration purposes and for clarity.

Figure 15:
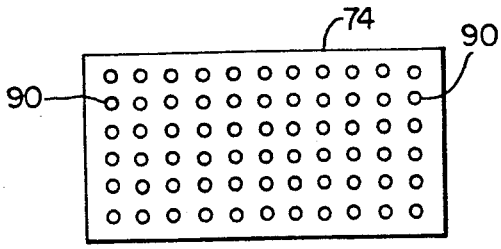
FIG. 15 is a plan view of a layer of perforated solid propellant prior to being formed into a scroll.

As in the sixth embodiment 70, the seventh embodiment 80 may also have the fast burning layer 84, or the moderate burning layer 86, or both such layers, perforated 90 or scored 92 as represented in FIGS. 15 and 16, respectively, to further enhance the burning control performance for programming.

The perforation 90 and/or the scoring 92 further increase the gas generation rate geometrically through an increase in the burning surface.

Figure 17:
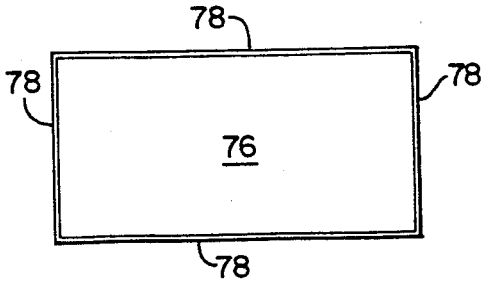
FIG. 17 is a plan view of a layered propellant, prior to being formed in a scroll, showing a coating on the edges of the layered propellant.
Figure 18:
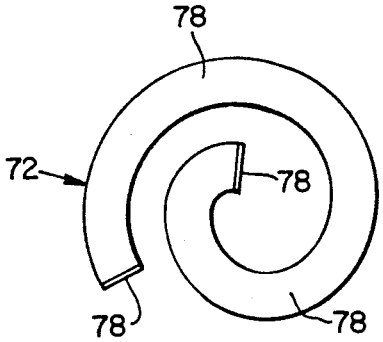
FIG. 18 is an end view of a layered grain in scroll-form, showing a coating on the edges.

Turning now to FIGS. 17 and 18, FIG. 17 shows a plane view of the sixth embodiment 70 before the layered combination with layer 76 on the outside is rolled into a scroll 72, and with the edges 77 of the layer 76 (and its associated other layers) coated or chemically altered 78 to prevent flame from reaching the edges and surfaces of the fast burning layers 74 until the progressive programmed burning of the outer layers 76 regresses to the point where the layer 74 is to ignite.

In FIG. 18 the sixth embodiment 70 is shown in scroll form 72 with the edges each coated or chemically altered 78 as described in FIG. 17 before being formed into a scroll 72 configuration. Thus, all exposed edges 77 of the layered propellant scroll 72 are coated or chemically altered 78 to prevent premature burning of the central layer 74. The coating or chemical alteration 78 is similar to the coating or chemical alteration 28 described hereinbefore regarding FIG. 5.

It is also to be noted that FIGS. 17 and 18 illustrate the coating or chemical alteration 78 applied to the sixth embodiment 70, however, they are also illustrative of a similar coating or chemical treatment applied to the edges of the seventh embodiment 80 for the same purpose. Only one set of illustrations (FIGS. 17 and 18) is presented for clarity.

The physical coating or chemical alteration mentioned hereinbefore is to prevent the flame, when ignited, from reaching the interior layer or layers until they have been exposed by regression of the outer lateral surfaces from burning.

As can be readily understood from the foregoing description of the invention, the present structure can be configured in different modes to provide a programmed-splitting solid propellant grain for improved ballistic performance of guns.

Accordingly, modifications and variations to which the invention is susceptible may be practiced without departing from the scope and intent of the appended claims.

What is claimed is:

1. A propellant for improved ballistic performance of guns, comprising:

a grain, said grain being a solid propellant, said grain having a diameter and an external surface, said grain having a longitudinal axis therethrough, said propellant being subject to burning when ignited; and a plurality of slits, said plurality of slits extending longitudinally through said grain of solid propellant, each of said plurality of slits having a width, said plurality of slits each having a longitudinal axis, said longitudinal axis of said grain and each axis of said plurality of slits being coincidental, said grain being capable of splitting into a plurality of programmed sections as said external surface regresses due to said burning, wherein each of said plurality of slits is equally sized and configured, and additionally, a plurality of perforations, said plurality of perforations being spaced apart, said plurality of perforations being longitudinally through said grain, said plurality of perforations being of a slit-like configuration in cross sectional.

2. A propellant for improved ballistic performance of guns, comprising:

a grain, said grain being a solid propellant, said grain having a plurality of layers, said plurality of layers after assembly as a layered grain being thereafter rolled into a scroll configuration, each layer of said plurality of layers of said grain having a specific burning capability, said propellant being subject to said burning when ignited, wherein at least one of said plurality of layers has a plurality of perforations therethrough, said plurality of perforations in said at least one of said plurality of layers further increasing the gas generation rate geometrically through an increase in the burning surface that results from said plurality of perforations.

3. A propellant for improved ballistic performance of guns, comprising:

a grain, said grain being a solid propellant, said grain having a plurality of layers, said plurality of layers after assembly as a layered grain being thereafter rolled into a scroll configuration, each layer of said plurality of layers of said grain having a specific burning capability, said propellant being subject to said burning when igntied, wherein at least one of said plurality of layers has a plurality of scored cuts across the surface thereof, said plurality of scored cuts across the surface thereof, said plurality of scored cuts across said surface of said at least one of said plurality of layers further increasing the gas generation rate geometrically through an increase in the burning surface that results from said plurality of scored cuts.

* * * * *